US006786328B2

(12) United States Patent
Honegger

(10) Patent No.: US 6,786,328 B2
(45) Date of Patent: Sep. 7, 2004

(54) METHOD AND DEVICE FOR TRANSFORMING A SUPPLY STREAM OF FLAT STREAM ELEMENTS, IN PARTICULAR A SUPPLY STREAM IN WHICH THE ELEMENTS ARE CONVEYED OVERLAPPING ONE ANOTHER

(75) Inventor: Werner Honegger, Bäch (CH)

(73) Assignee: Ferag AG, Hinwil (CH)

( * ) Notice: Subject to any disclaimer, the term of this patent is extended or adjusted under 35 U.S.C. 154(b) by 0 days.

(21) Appl. No.: 10/736,367

(22) Filed: Dec. 15, 2003

(65) Prior Publication Data

US 2004/0124066 A1 Jul. 1, 2004

(30) Foreign Application Priority Data

Dec. 20, 2002 (CH) ..... 2187/02

(51) Int. Cl.[7] ..... B65G 47/26; B65G 47/46
(52) U.S. Cl. ..... 198/890.1; 198/440
(58) Field of Search ..... 198/890.1, 440; 271/286, 281

(56) References Cited

U.S. PATENT DOCUMENTS

| | | | | |
|---|---|---|---|---|
| 3,774,748 A | * | 11/1973 | Dederer et al. | 198/444 |
| 3,780,850 A | * | 12/1973 | McSwiggin | 198/802 |
| 4,138,008 A | * | 2/1979 | Del Rosso | 198/890.1 |
| 4,170,288 A | | 10/1979 | Mebus | |
| 4,287,980 A | * | 9/1981 | Montferme | 198/419.3 |
| 4,508,206 A | * | 4/1985 | Moore et al. | 198/890.1 |
| 4,632,238 A | * | 12/1986 | Risi | 198/890.1 |
| 4,678,172 A | | 7/1987 | Faltin | |
| 4,948,110 A | | 8/1990 | Singer | |
| 5,217,103 A | * | 6/1993 | Umlauf | 198/890.1 |
| 5,323,912 A | * | 6/1994 | Fan et al. | 209/593 |
| 5,388,682 A | * | 2/1995 | Dudley | 198/367 |
| 5,657,858 A | * | 8/1997 | Van Den Goor | 198/890 |
| 5,722,532 A | * | 3/1998 | Troisi et al. | 198/890 |
| 5,988,351 A | * | 11/1999 | Warkentin | 198/370.04 |
| 6,223,884 B1 | * | 5/2001 | Ronchi | 198/457.01 |
| 6,401,903 B1 | | 6/2002 | Berni | |
| 6,481,559 B1 | * | 11/2002 | Maeda et al. | 198/370.02 |
| 6,491,153 B1 | | 12/2002 | Cassoni et al. | |
| 6,581,752 B2 | | 6/2003 | Frei | |
| 6,702,106 B1 | * | 3/2004 | Sweazy | 198/890 |

FOREIGN PATENT DOCUMENTS

| | | |
|---|---|---|
| CH | 440 130 | 7/1967 |
| DE | 29 17 250 | 10/1980 |
| EP | 1 188 670 A1 | 8/2001 |

* cited by examiner

*Primary Examiner*—Douglas Hess
(74) *Attorney, Agent, or Firm*—Rankin, Hill, Porter & Clark LLP

(57) ABSTRACT

A method for transforming a supply stream (2) of elements (1) having one flat object or a group of flat objects lying on top of one another that are conveyed overlapping one another to produce a stream in which the stream elements are distanced from one another both transverse and parallel to the conveying direction (F). The stream elements are oriented parallel to the conveying direction (F). Every stream element (1) is gripped in a same location which, in the conveying direction (F), is situated in the center of the element and in which location the element is not overlapped by adjacent elements (1). Every stream element is then displaced transverse to the conveying direction (F), while the spatial element orientation remains essentially unchanged. The displacement is different for successive stream elements (1) in a predefined sequence. For gripping the stream elements (1) in a clamping manner, clamping elements (5.1) are used, which are capable of being displaced transverse to the conveying direction (F) along guide links (6).

20 Claims, 7 Drawing Sheets

METHOD AND DEVICE FOR TRANSFORMING A SUPPLY STREAM OF FLAT STREAM ELEMENTS, IN PARTICULAR A SUPPLY STREAM IN WHICH THE ELEMENTS ARE CONVEYED OVERLAPPING ONE ANOTHER

BACKGROUND OF THE INVENTION

1. Field of the Invention

The invention is situated in the field of materials handling technology and it concerns a method and a device serving for transforming a supply stream, in which flat stream elements are conveyed with their flat expanse aligned essentially parallel to the conveying direction and in particular overlapping one another. The method and the device in particular serve for transforming a supply stream being conveyed in a loosely supported manner and comprising, as stream elements, groups of flat objects (e.g. printed products) having different formats and lying loosely on top of one another, the groups overlapping one another. This supply stream is transformed into a conveying stream, in which the groups again are conveyed loosely supported, but are at a distance from one another, so that, for example, they can be supplied to a packaging operation using a packaging material supplied from a roll.

2. Description of Related Art

Transformation of a supply stream (imbricated stream), in which individual, flat objects, such as printed products, are conveyed overlapping one another, into a stream in which the objects are conveyed behind one another and, if so required, at a distance from one another, is, according to the state of the art realized by accelerating the objects such that their spacing becomes greater than their expanse in the conveying direction. This method is unproblematic if the flat stream elements are stable and the conveying rates (in elements per unit of time) are not very high. For high conveying rates and for stream elements that are relatively long in the conveying direction, such methods give very high conveying speeds, and starting from a supply stream-with a high degree of overlap necessitates also high accelerations, for the mastering of which in particular not very stable stream elements, for stabilization, are gripped at their leading edge.

In order to circumvent the difficulties mentioned above, it is also proposed to split up an imbricated stream of the type mentioned into part streams, wherein at a switch-point stream sections are alternately supplied to one or the other of the part streams from the leading end of the imbricated stream, the stream sections being groups of overlapping stream elements. By subsequent suitable transformation, the partial streams can be made into streams in which the stream elements are conveyed one behind the other and which, due to the reduced conveying rate resulting from the splitting-up, are conveyed at a speed that is correspondingly lower than in the case described above.

The sections of the imbricated stream alternately assigned to each part stream usually are deviated from the main stream in a direction transverse to the principal surfaces of the flat stream elements (for a loosely supported imbricated stream: downwards or upwards), which deviation can be realized using a very simple device, such as a pivoting conveying substrate.

If an imbricated stream is to be directly transformed into part streams (i.e. without further transformation of the part streams) in which the stream elements are conveyed without overlap, i.e. behind one another and at a distance from one another, it is necessary to deviate from the imbricated stream not streams sections comprising a plurality of overlapping elements each, but rather individual elements. For this purpose, every element has to be gripped individually prior to the splitting-up, usually with the help of two gripper conveyors, as, for example, described in the publication EP-1063187 (or U.S. Pat. No. 6,401,903), one gripper conveyor being assigned to each longitudinal edge of the imbricated stream and one gripper conveyor being arranged on each side of the stream. In a gripping zone, the gripper conveyors run parallel to the imbricated stream, and downstream of the gripping zone they diverge. The gripper conveyors are operated in synchronism with the imbricated stream such that the grippers of one of the conveyors grip every second stream element from one side (longitudinal edge zone of the stream) and the grippers of the other conveyor grip the other stream elements from the other side. The gripped stream elements are then moved apart by the diverging gripper conveyors and are then, for example, transferred to further conveying means.

For splitting an imbricated stream as described in the last paragraph it is necessary that the two opposite edges of the flat stream elements situated on both sides of the imbricated stream can always (for all stream elements) be gripped in the same way. This means that these edges of all stream elements need to be positioned the same way in the imbricated stream. Or it means that the supplied, overlapping stream elements all have to have the same width. Splitting into more than two partial streams is not possible. For being able to grip individual stream elements it is further necessary that in the imbricated stream to be split-up the overlap of the stream elements is such that there are locations without overlap. If this condition is not fulfilled, the leading stream element needs to be laterally moved away from the supply stream before the next stream element can be gripped, which in particular in the case of stream elements of little stability is very difficult to implement.

For splitting imbricated streams by deflecting individual stream elements, it is also possible to grip the leading edge of the one stream element positioned at the leading end of the imbricated stream, as described in the publication EP-1155992. These leading edges are alternately gripped by the grippers assigned to the part streams to be established, and the gripper tracks diverge downstream of the gripping zone. For such splitting methods, the same severe conditions apply for the leading stream element edges as is the case for the lateral element edges in the method described further above. On the other hand, however, this method makes it possible to split the imbricated stream into more than two part streams. Because the leading edge of an element can only be gripped when the preceding stream element is situated at a distance from the leading end of the imbricated stream, on splitting a loosely supported stream, pairs of downstream and upstream elements have to be moved relative to one another, when only the downstream element is held gripped but not the upstream one. This can become a problem if the stream elements are unstable.

As long as the stream elements being conveyed in the imbricated supply stream are individual flat objects of the same format overlapping one another in a regular manner (regular scale spacing), the conditions as mentioned above to be fulfilled by the supply stream for being able to be split by gripping and leading apart individual stream elements according to the methods of the state of the art do not represent a problem. Even when groups of objects of the same format lying stacked one upon the other constitute the overlapping stream elements of the imbricated stream, there are no significant difficulties due to these conditions. If, however, the overlapping stream elements of the imbricated stream are groups of flat objects lying loosely upon one another and having differing formats and shapes and/or being stacked non-uniformly, it becomes considerably more difficult or even impossible to create an imbricated stream in which the mentioned conditions are fulfilled. This is in particular the case, because it is necessary, that in every gripped group all objects are gripped, but no object of a preceding or following group is gripped also.

SUMMARY OF THE INVENTION

It is an object of the invention to create a method and a device to transform, with simple means, a supply stream of stream elements (individual flat objects or groups of flat objects lying one upon the other) being conveyed overlapping one another, into at least one conveying stream of stream elements that do not overlap one another, but rather are conveyed one behind the other and possibly also beside each other. The inventive method and device are to allow a significantly greater degree of freedom regarding characteristics of the stream elements and their arrangement in the supply stream and in the at least one conveying stream to be established, than is the case for the known methods described above which serve the same purpose. In particular, it is to be possible to transform supply streams of overlapping groups each comprising flat objects of differing formats lying one upon the other or objects with the same format lying one upon the other not in the form of a regular stack, with a minimum of conditions regarding the arrangement of the objects in the groups and the arrangement of the groups in the supply stream. Nonetheless, the device to be created for the implementation of the method is to be simple and in particular is to be adaptable in an as simple as possible manner to varying characteristics of the stream elements of the supply stream and to different requirements made of the stream transformation.

According to the fundamental idea of the method of the invention, for transforming the supply stream being continuously conveyed in a conveying direction, first, the stream elements of the supply stream overlapping one another and advantageously being loosely supported are individually gripped and then they are differently displaced in a regular sequence transverse to the conveying direction. The spatial orientation of the stream elements thereby remains substantially unchanged so that, following the displacement, the stream elements can be released and can, for example, be conveyed away once again loosely supported. For gripping, displacing, and simultaneously conveying away the stream elements, these are not gripped in the zone of their leading edges, but rather at a location distanced in a conveying direction from the leading edge and advantageously being situated in the conveying direction approximately in the middle of the stream elements. The gripping location, as required, may include or not include a lateral element edge and is essentially the same for all stream elements of the supply stream. The sole condition to be imposed on the supply stream is that it must be possible to grip all stream elements in the same way and that the stream elements do not overlap one another at the gripping location, i.e. that the spacing of the stream elements in the supply stream is greater than half the length of the stream elements in the conveying direction.

For gripping, displacing, and simultaneous onward conveying, for every stream element an upper and a lower clamping element is provided. The stream element is gripped by being clamped between the clamping elements transverse to its flat expanse (for a loosely supported stream element: from above and from below). The upper and the lower clamping elements are conveyed in the conveying direction with the same, essentially constant speed as the supply stream and with, in conveying direction, a constant distance or spacing between one another which distance is substantially the same as the element spacing in the supply stream. In addition, the clamping elements are displaceable in a controlled manner to a varying degree transverse to the conveying direction. As still remains to be demonstrated, this ability of being displaced may be limited to the upper clamping elements, depending on the requirements regarding additional support of the stream elements during displacement and onward conveyance. In such a case, lower clamping elements are provided being assigned to different diverging tracks and being conveyed along these tracks.

Advantageously, the transverse displacement is implemented parallel to the flat expanse of the stream elements (for loosely supported stream elements: essentially horizontally) such that the stream elements following the displacement are arranged beside each other. In doing so a conveying stream is produced, in which the stream elements, for example, are conveyed behind and beside each other in a staggered manner, distanced from one another parallel to the conveying direction and transverse to the conveying direction, i.e. a conveying stream, which in a simple manner can be conveyed away by a single conveyor belt and which is especially suitable for packaging the stream elements with the help of a quasi endless packaging material supplied from a roll. Such packaging is, for example, described in the publication EP-1188670. The number of stream elements being conveyed beside each other in such a conveying stream is in essence freely selectable.

The displacement, however, may also be implemented transverse to the flat expanse of the stream elements (for loosely supported stream elements: vertically), wherein the stream elements have to have a sufficient flexibility for the displacement and wherein part streams arranged one above the other are produced, in which part streams the stream elements are conveyed one behind the other and, for example, with a distance between one another. The number of part streams that can be produced in such a manner is in essence freely selectable.

For being able to grip the stream elements in a location, which does not include an edge, the upper and the lower clamping elements are independent of one another, i.e., they are coupled to separate driving means. For gripping in a lateral edge zone, it is advantageous to combine each upper clamping element with one lower clamping element to form a clamp and to couple the clamps to a single drive means. The drive means for driving the clamping elements advantageously are chain pairs driven in circulation, wherein the two chains are arranged on two opposite sides of the supply stream each wherein guide links are arranged between the two chains. The guide links extend transverse to the conveying direction and each guide link carries a clamping element or a clamp being displaceable to and fro between the chains. The length of the guide links or the distance between the circulating chains, respectively, is matched to the distance transverse to the conveying direction to be established between the stream elements. Furthermore, the drive means comprise control means for controlling the different displacements of the clamping elements along the guide links in the predefined, regular sequence. If possible, the control means are designed as stationary cams.

The most important advantages of the stream transformation in accordance with the invention are that all stream elements of the supply stream can be gripped in essentially the same location and before the stream elements are moved relative to one another, that the gripping location can be located in a central zone (without involvement of an element edge), that, in the conveying stream to be established, a substantially freely selectable number of stream elements can be conveyed beside each other or an essentially freely selectable number of part streams can be established respectively, and that the spatial orientation of the stream elements is not altered so that, for example, stream elements being supplied in a loosely supported manner can be conveyed away again in a loosely supported manner after the stream transformation without the need of a further re-orientation. The advantages of the central gripping location, the advantage of the prevention of relative movement of stream elements not yet held gripped and the advantage of the spatial stream element orientation remaining unchanged are particularly relevant for stream elements that are groups of flat objects loosely lying on top of one another, and in particular for such groups in which the objects have different formats or in which the objects have similar formats but are not regularly stacked within the group.

It goes without saying that it is also possible to utilize the method and the device according to the invention for transforming supply streams comprising other stream elements, for example for transforming supply streams of individual objects all having the same format or of regular stacks of objects of the same format or also for transforming supply streams in which such stream elements do not overlap one another, but rather are conveyed one behind the other. In the same manner, while the method and the device according to the invention are very advantageous for establishing conveying streams in which the stream elements are at a distance from one another (i.e. do not overlap), it is equally possible to use the method and the device for producing streams in which the stream elements overlap one another, i.e. for changing the manner of the overlapping of the supply stream. It is further possible to use the method and the device according to the invention for splitting the supply stream into sections, i.e., into groups of overlapping stream elements, and to convey these away either beside or above one another.

BRIEF DESCRIPTION OF THE DRAWINGS

Exemplary embodiments of the method and of the device in accordance with the invention are described in more detail in connection with the following drawing figures, wherein:

(FIG. 1: viewed in a direction vertical to the flat expanse of the stream elements; FIG. 2: viewed in a direction parallel to the flat expanse of the stream elements);

DETAILED DESCRIPTION OF THE PREFERRED EMBODIMENTS

Figure 1:
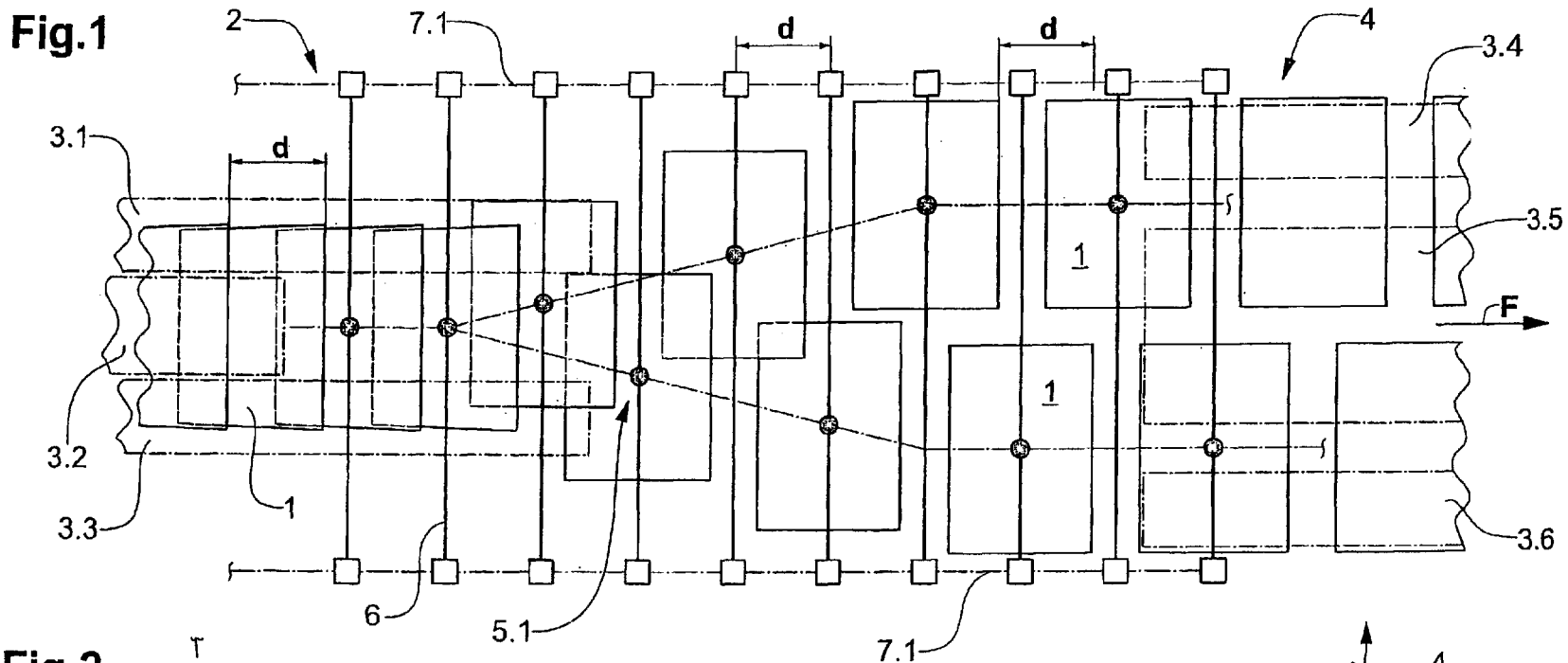
FIGS. 1 and 2 are schematic illustrations of a first exemplary embodiment of the method and the device according to the invention, wherein the stream elements are gripped in a central zone and are displaced parallel to their flat expanse
Figure 2:
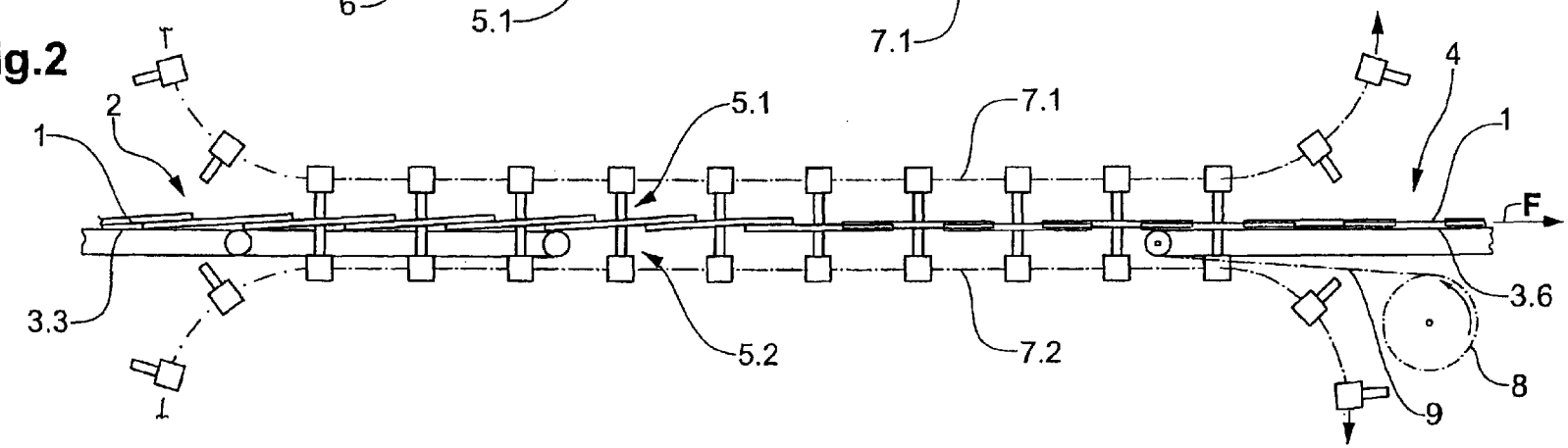

FIGS. 1 and 2 show very schematically, viewed in a direction transverse to the flat expanse of the stream elements 1 (FIG. 1) and in a direction parallel to the flat expanse of the stream elements (FIG. 2), a first embodiment of the method and the device according to the invention. The conveying direction F is oriented from left to right. The left-hand area of FIGS. 1 and 2 illustrates the supply stream 2 in which the stream elements 1 are conveyed overlapping one another with a scale spacing d and, for example, are loosely supported on three conveying substrates 3.1, 3.2, 3.3 running parallel to one another (indicated with dot-dash lines, e.g., conveyor belts). The middle area of FIGS. 1 and 2 is the transformation zone, in which the stream elements 1 are displaced transverse to the conveying direction F, in this case parallel to the flat expanse of the stream elements, i.e. approximately horizontally in the case of a loosely supported supply stream. The right-hand area of FIGS. 1 and 2 illustrates the conveying stream 4 established by transforming the supply stream, in which conveying stream the stream elements 1, for example, are conveyed away once again loosely supported on three parallel conveying substrates 3.4, 3.5 and 3.6 (illustrated with dot-dash lines, e.g., conveyor belts). The effective spacing d between the stream elements in the conveying direction remains unchanged by the transformation, i.e., the conveying speed of conveying stream 4 is the same as the speed of supply stream 2. Also the conveying direction F remains essentially unchanged and the spatial orientation of the stream elements does not change either.

In the transformation zone (middle area of the FIGS. 1 and 2) upper and lower clamping elements 5.1 and 5.2 are utilized. The clamping elements are conveyed through the transformation zone one behind the other with a spacing d in the conveying direction F and with the speed of the supply stream 4. During this conveyance, the clamping elements are first adjusted to the location of the stream elements 1 to be gripped (in the illustrated case: center of the stream elements), then they are activated for gripping (brought into a clamping configuration), then they are displaced transverse to the conveying direction F wherein displacement of subsequent clamping elements is different in a predefined sequence (in the illustrated case alternately in opposite direction), and finally they are de-activated (brought into a non-clamping configuration).

In the embodiment in accordance with FIG. 1, the location of the stream elements to be gripped is situated approximately in the middle of the stream element. For being conveyed in conveying direction F through the transformation zone, the clamping elements 5.1 and 5.2, for example, are arranged on guide links 6 extending transverse to the conveying direction F and being joined to two lateral drive organs (7.1/7.1' for the upper clamping elements 5.1 and 7.2/7.2' for the lower clamping elements 5.2, shown as dot-dash lines). The drive organs are, for example, chains driven in circulation. The drive organs extend through the transformation zone beside the supply stream 2 and in the case at hand at a symmetrical distance from it. On designing the lower clamping elements 5.2, the guide links 6, and the conveying substrates 3.1 to 3.6 for the supply stream and the produced conveying stream, it has to be made sure that these do not come into conflict with one another. For stream elements that are bendable or flexible to such an extent that also within the transformation zone they cannot be conveyed without further support, additional supporting elements have to be provided. Such additional supporting elements are to be designed to not obstruct movement of the lower clamping elements 5.2.

The conveying substrates 3.1 to 3.6 illustrated in the FIGS. 1 and 2 (e.g. conveyor belts) partially extend between the lower guide links 6 and the conveying surface. Of the conveying substrates 3.1, 3.2, and 3.3 supporting the supply stream 2, the middle one 3.2 extends in the conveying direction less far than the two outer ones 3.1 and 3.3. The lower clamping elements 5.2 are brought in and activated at a point downstream of the end of the middle conveying substrate 3.2. When gripped by the clamping elements, the stream elements are further supported by the outer conveying substrates 3.2 and 3.3 until these end too. The conveying substrates 3.4 to 3.6 conveying away the stream elements 1 of the conveying stream 4 established by the transformation are arranged at a distance from one another such that the lower clamping elements 5.2 can be conveyed away downwards in a zone in which the stream elements are supported by the mentioned conveying substrates 3.4 to 3.6.

As already mentioned, in the case illustrated in the FIGS. 1 and 2 the clamping elements are brought in centrally and are displaced transverse to the conveying direction F alternately to the same extent and in opposite directions. The extent of the displacement (and with it the length of the guide links 6), for example, is selected such that the stream elements in the conveying stream 4 are arranged at a distance from one another transverse to the conveying direction F, as illustrated. From FIGS. 1 and 2 it is easily seen, that a displacement sequence in which every first stream element is displaced to the right, every second stream element is displaced to the left and every third stream element is not displaced, results in a conveying stream 4 in which three stream elements are arranged beside each other. In the same way, a displacement sequence, in which a first plurality of stream elements is displaced to the right and a second plurality of stream elements is displaced to the left, results in a conveying stream 4, in which imbricated stream sections are conveyed beside one another. Innumerable further transformation possibilities are derivable in the same manner. As still remains to be demonstrated, it is very easily possible to convert a device in accordance with the invention that is set-up for one of the above mentioned transformation variants, for another one, this under the proviso, that the guide links 6 are sufficiently long.

FIG. 2 further shows, in dot-dash lines, a roller 8 from which a length of a packaging material 9 is continuously fed underneath the conveying stream 4 established by the transformation. Further downstream, the stream elements 1 are then, for example, welded into the packaging material during continuous onward conveyance. It goes without saying that for an application of this kind at least the lower clamping elements 5.2 cannot be brought into the area of the conveying substrates 3.4 to 3.6, but rather have to be turned around further upstream.

Figure 3:
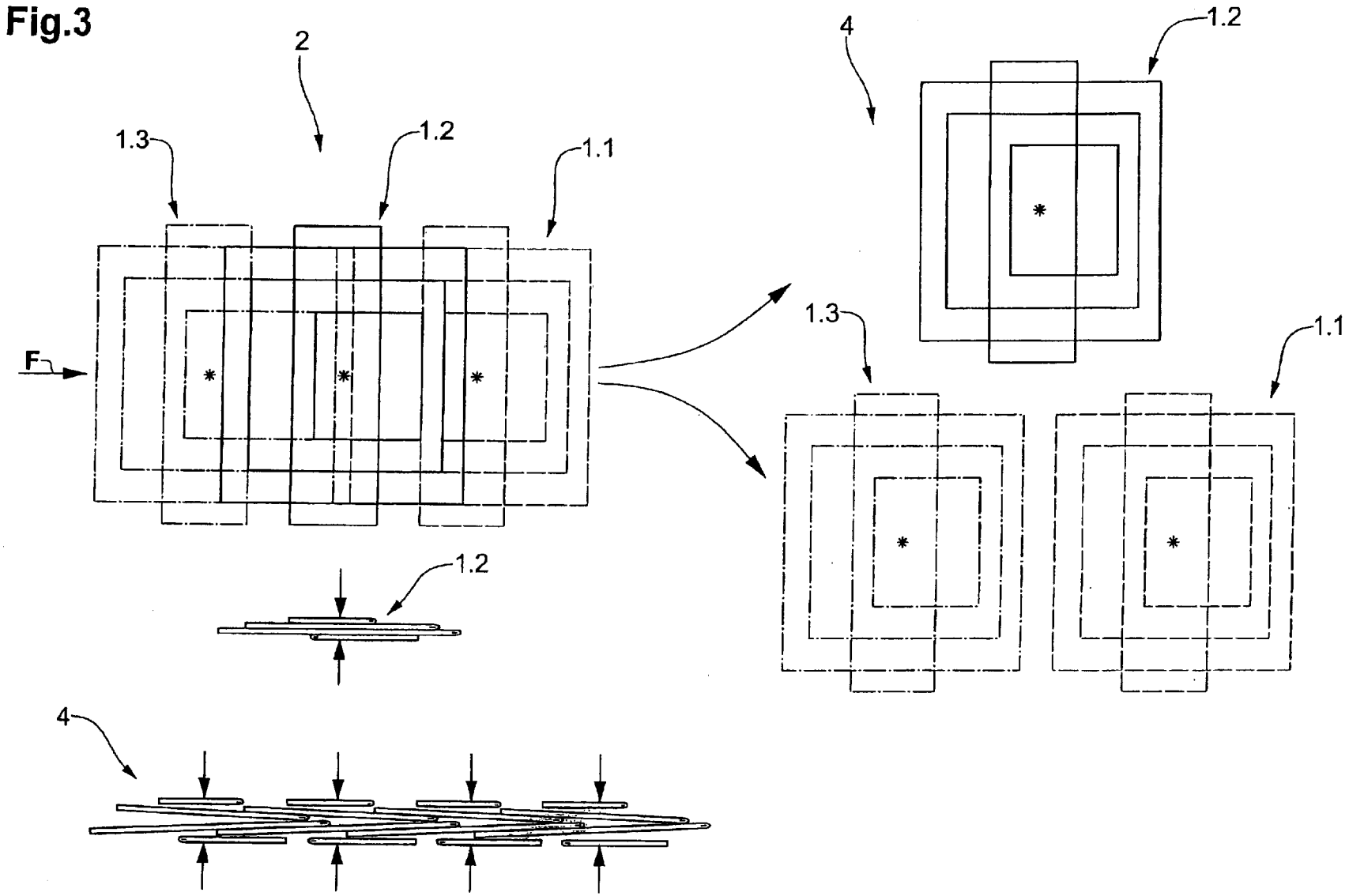
FIGS. 3 to 7 show examples of stream elements being capable of being advantageously processed with the method and the device according to FIG. 1, which stream elements are groups of objects having different formats (FIGS. 3 to 6) or of objects having the same format (FIG. 7), the objects being printed products.
Figure 4:
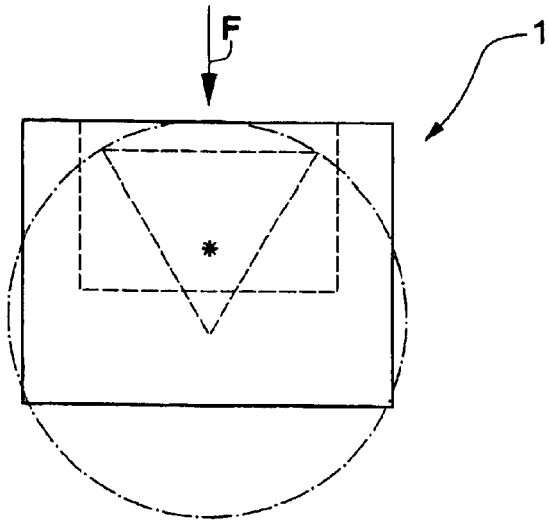
Figure 5:
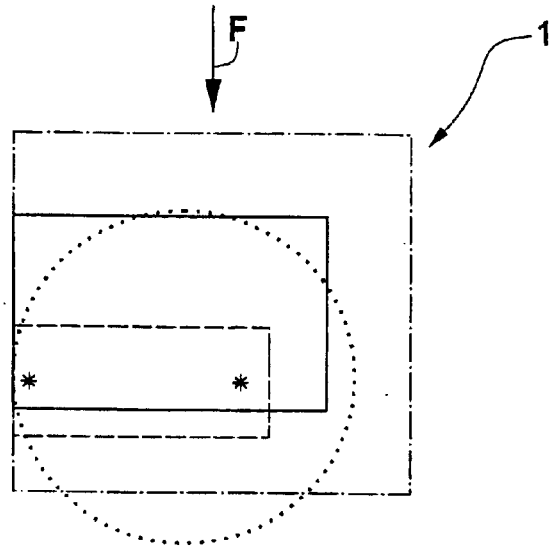
Figure 6:
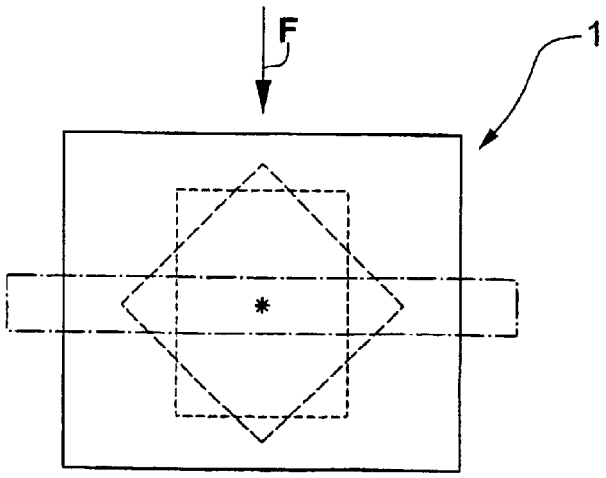
Figure 7:
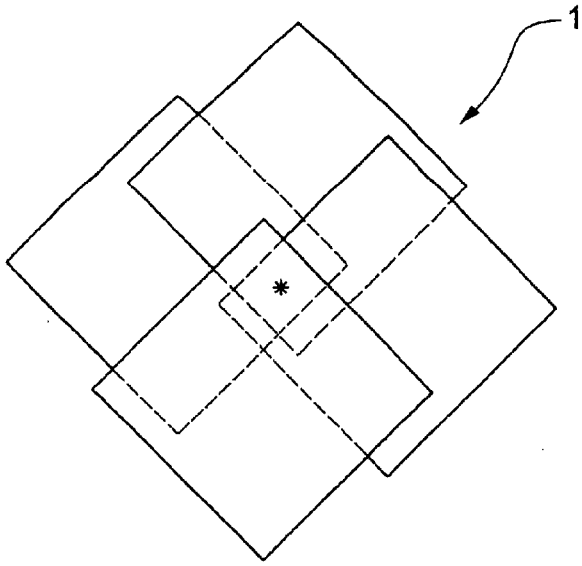

FIG. 3 shows in more detail three stream elements 1.1 to 1.3 each consisting of a plurality of objects. The stream elements are supplied in a supply stream 2 in which they overlap one another and, following transformation according to the invention, are conveyed away in a conveying stream 4 in which they are distanced or spaced from one another. In the horizontal projection of the upper part of FIG. 3, the most downstream stream element 1.1 is depicted with dashed lines, the middle stream element 1.2 with unbroken lines, and the most upstream stream element 1.3 with dot-dash lines. The location in which the stream elements are to be gripped is marked with an asterisk. All objects constituting one stream element are gripped in this one location and the element overlap in the supply stream is selected such that no objects of adjacent elements are also gripped. Each of the stream elements 1.1 to 1.3 comprises four flat objects (e.g. printed products) lying loosely on top of one another and having differing formats.

The gripping location indicated with the asterisk advantageously is as large as possible. Its extension in the conveying direction is limited by the element overlap; its extension transverse to the conveying direction is advantageously not greater than the range in which all objects of the group can be clamped. The gripping location may be, as indicated by the asterisk, a round or square area, a row of such areas, or a rectangular area.

The lower part of FIG. 3 shows the middle stream element 1.2 and the supply stream 4 viewed in a direction parallel to the flat expanse of the stream elements. The locations to be gripped are indicated with arrows from above and below. This illustration shows that the supply stream can be established by bringing together a plurality of object streams, wherein each object stream supplies one type of object. Conveying speed and object spacing are to be the same in all object streams to be brought together and the object streams have to be synchronized such that the element locations to be gripped remain free from overlap by objects of adjacent stream elements. In a group stream established by bringing together different object streams, it is not actually the stream elements or groups that overlap one another, but rather it is the objects of the groups, which overlap one another. On the other hand it is of course also possible to transform a supply stream, in which it is the groups (stream elements) that overlap one another. From FIG. 3 it is also evident that the direction of the overlap (leading edges facing downwards or upwards) is not relevant for the transformation according to the invention.

FIGS. 4 to 7 illustrate further stream elements 1, each being a group of flat objects lying on top of one another, wherein an advantageous gripping location is indicated with an asterisk. Supply streams in which groups of this kind are supplied overlapping one another are advantageously transformed according to the invention. The objects constituting the group (stream element 1) according to FIG. 4 have differing formats and are lying on top of one another asymmetrically; the gripping location is situated relative to a direction transverse to the conveying direction in the middle of the element, and relative to a direction parallel to the conveying direction it is situated off center. The objects of the group (stream element 1) in accordance with FIG. 5 also have differing formats and are aligned laterally; the gripping location in this case being situated in the area of the lateral edge of the group and possibly extending towards the center of the group. The objects of the group (stream element 1) according to FIG. 6 also have differing formats and are symmetrically arranged; the gripping location for this reason advantageously being situated exactly in the center of the stream element. The objects of the group (stream element 1) in accordance with FIG. 7 all have the same format and they are arranged in the form of a rosette, the gripping location also in this case being situated advantageously in the center of the stream element.

Figure 8:
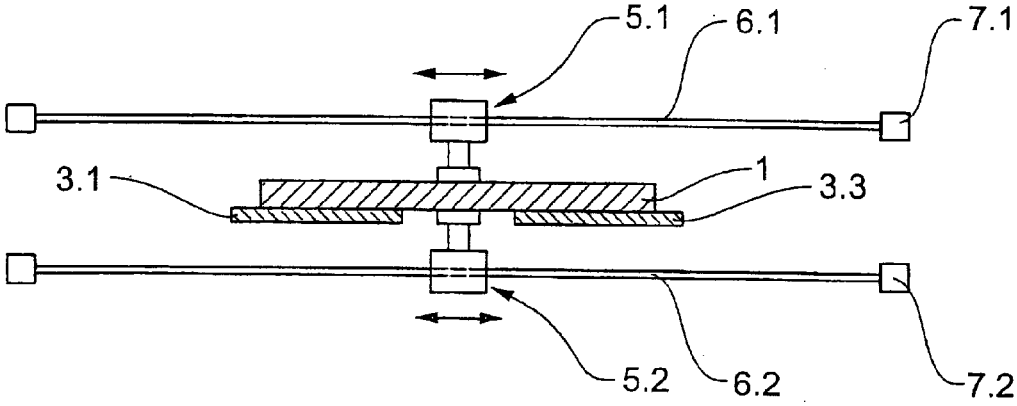
FIGS. 8 to 10 show various exemplary embodiments of lower and upper clamping elements suitable for the device according to FIG. 1 (section transverse to the conveying direction)
Figure 9:
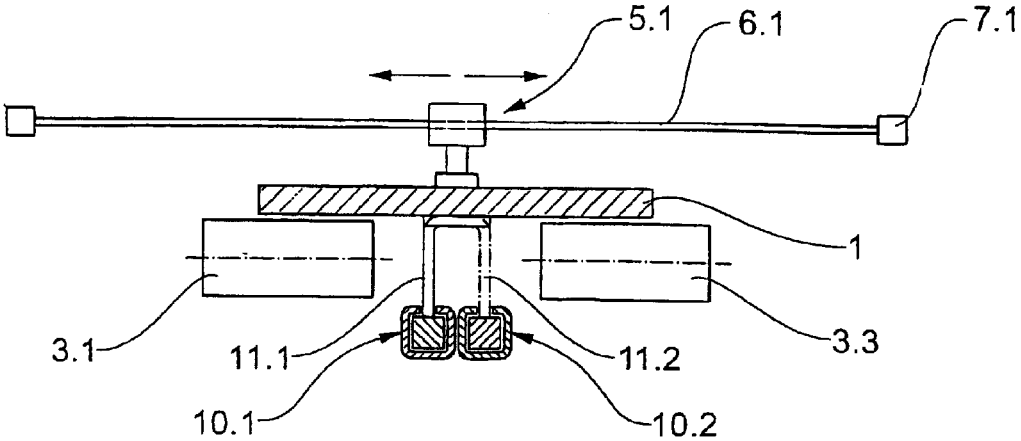
Figure 10:
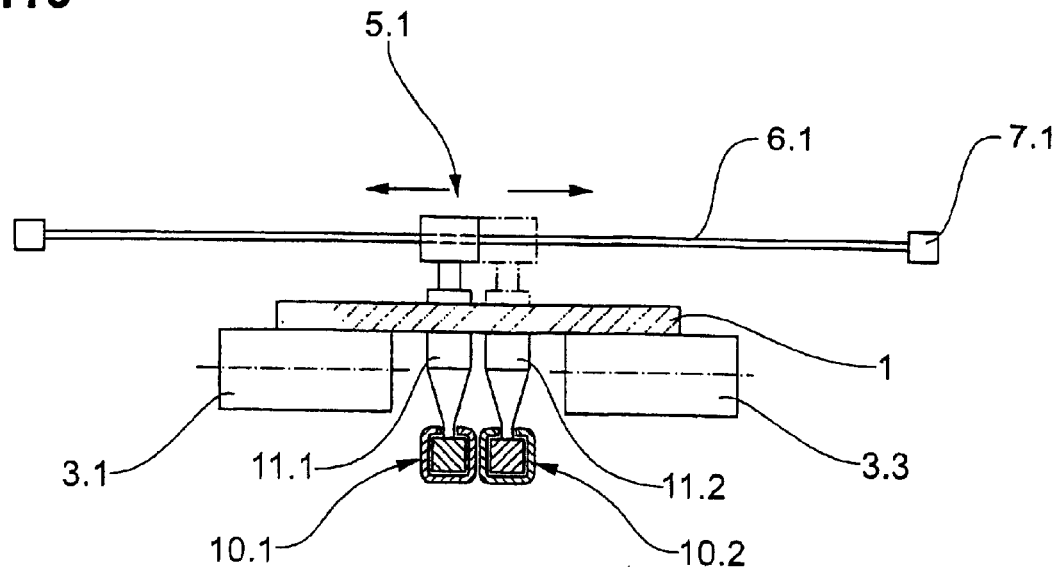

FIGS. 8 to 10 illustrate various embodiments of upper and possibly lower clamping elements (sections transverse to the conveying direction), which are suitable for the devices according to FIGS. 1 and 2 or for similar devices according to the invention.

FIG. 8, like FIG. 2, illustrates essentially identical upper and lower clamping elements 5.1 and 5.2, each one being arranged on a guide link. 6.1 and 6.2 along which it is displaceable transverse to the conveying direction. Also depicted are the conveying substrates 3.1 and 3.3 supporting a stream element 1 of the supply stream (not shown) when it is already gripped between clamping elements 5.1 and 5.2.

FIG. 9 illustrates an embodiment in which only the upper clamping elements 5.1 are displaceable transverse to the conveying direction in the manner as described above, while the function of the lower clamping element is taken over by two conveying organs 10.1 and 10.2 (for example, conveying organs circulating in slotted channels, e.g., chains), on which counter elements 11.1 and 11.2 are arranged. The counter elements of each conveying organ are distanced or spaced from one another by twice the distance between the upper clamping elements 5.1. The counter elements 11.1 and 11.2 of the two conveying organs 10.1 and 10.2 are directed against one another such that, independent of on which conveying organ they are arranged, they are capable of counter acting an upper clamping element within an identical range. In the gripping zone, the conveying organs run beside each other (as depicted in FIG. 9) and parallel to the supply stream and, in the transformation zone, they diverge. Because the characteristics of the movements of the upper clamping elements and of the counter elements replacing the lower clamping elements are not exactly the same, if so required it is advantageous to equip the pressure surfaces of the counter elements such that a gripped stream element is able to slightly slip on it.

FIG. 10, like FIG. 9, illustrates an embodiment of clamping means with upper clamping elements 5.1 being displaced transverse to the conveying direction, and lower counter elements 11.1 and 11.2 arranged alternately on diverging conveying organs 10.1 and 10.2. In contrast to FIG. 9, here the counter elements of both conveying organs are designed the same so that they are not able to provide counter action in the same region. For this reason, on clamping, the upper clamping elements 5.1 are alternately slightly displaced transverse to the conveying direction relative to each other.

From FIGS. 9 and 10 it is clearly evident, that utilization of conveying organs 10.1 and 10.2 with counter elements 11.1 and 11.2 instead of lower clamping elements 5.2 being displaced transverse to the conveying direction (FIG. 8) leaves more space for the conveying substrates 3.1 and 3.3 (also 3.3 to 3.6 in FIGS. 1 and 2), while this space when utilizing lower clamping elements (FIG. 8) is limited by the lower guide links. Therefore, in the embodiments in accordance with FIGS. 9 and 10, the conveying substrates may be designed as conveyor belts without causing any space problems, wherein the conveying organs 10.1 and 10.2 can be arranged between the conveyor belts. Quite obviously, however, this advantage is compensated by the restriction to one only possible transformation, which is defined by the course of the installed conveying organs 10.1 and 10.2 and by the sequence of the counter elements 11.1 and 11.2 arranged on them.

Figure 11:
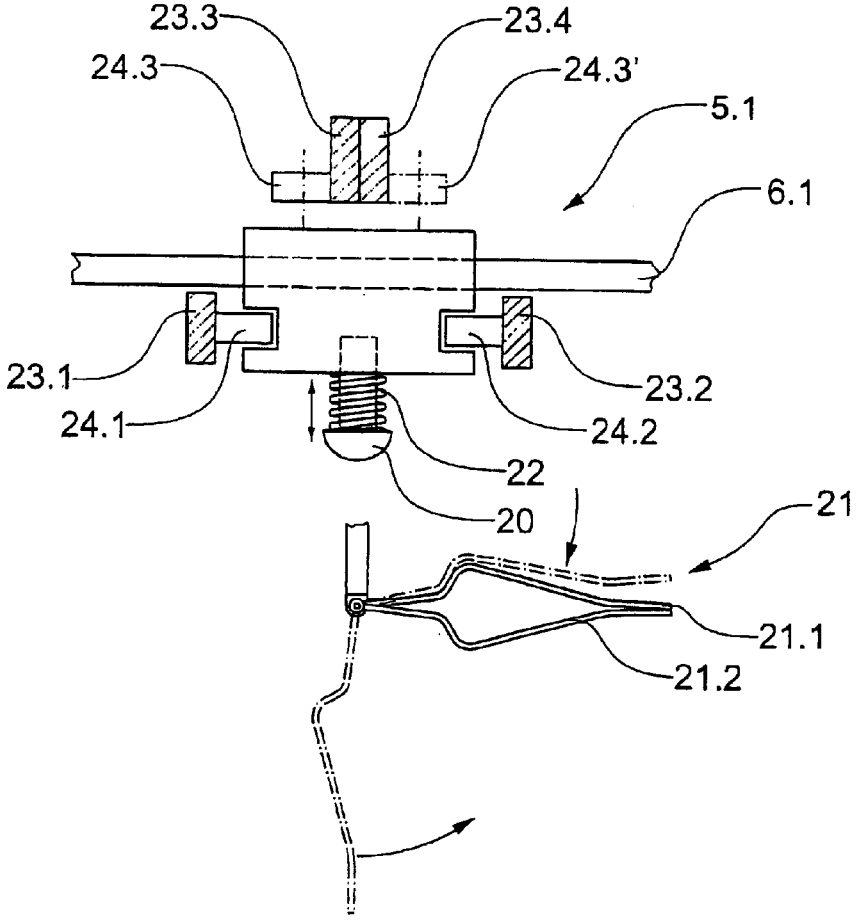
FIG. 11 shows an exemplary upper clamping element or pair of lower and upper clamping elements for a device in accordance with the invention and the control thereof.

FIG. 11 depicts an exemplary, upper clamping element 5.1, as it may be utilized in a device according to the invention, for example, according to the FIGS. 1 and 2. The clamping element 5.1, as already mentioned, is displaceably arranged on a guide link 6.1, which advantageously is designed as a double bar. The clamping element 5.1 comprises a clamping head 20 that is directed against the stream element (not illustrated) to be gripped and can advantageously be activated in a controlled manner. Alternatively, the clamping element 5.1 is a clamp.

The clamping head 20 co-operates with the corresponding clamping head of a lower clamping element or with a counter element and is blocked in a stand-by position with suitable means, e.g. biased by spring 22. The clamping head is activated by unblocking when, due to the pre-tension of the spring, it is pressed against the lower clamping element or the counter element. The clamp 21 takes over the function of lower and upper clamping element and is activated by closing and pressing together the two clamp parts 21.1 and 21.2. The clamp 21 is utilisable for the transformation of a supply stream in which the stream elements can be gripped in a location comprising a lateral element edge (refer in particular to FIGS. 5 and 12).

For controlling the displacement of the clamping element 5.1 along the guide link 6.1, for example, stationary control members or cams 23.1 to 23.4 are provided, along which control rollers 23.1 and 23.2 arranged on the clamping element 5.1 roll. The two cams 23.1 and 23.2 of the embodiment illustrated in FIG. 1 converge in the conveying direction to run parallel to each other from where the stream elements of the supply stream are to be gripped. In doing so, they co-operate with the guide rollers 24.1 and 24.2. They converge, for example at a location toward the middle of the guide links. The two cams 23.3 and 23.4 extend across the transformation zone diverging in conveying direction and in doing so co-operate with the guide roller 24.3 or 24.3', which are mounted alternately by being plugged in on the right or on the left of the clamping element.

Other per se known means can also be applied for controlling the transverse displacement of the clamping elements. For controlling the transverse displacement of the clamping elements along differing paths, it is possible to displace cam parts or control rollers on the clamping elements.

A lower clamping element 5.2 illustrated in FIGS. 2 and 8 is, for example, equipped in the same way as the clamping element 5.1 of FIG. 11, wherein the clamping head 20 or the clamp 21 faces upwards.

FIG. 11 clearly shows how simple it is to adapt a device for differing transformations, if it comprises clamping elements of the type illustrated here. If the extent of the lateral displacement of the clamping elements changes, cams 23.3 and 23.4 are displaced. If the location to be gripped is not situated centrally, cams 23.1 and 23.2 are adjusted accordingly. If the displacement sequence is to be changed, on at least a part of the clamping elements the control roller 24.3 is displaced (plugged-in differently). For producing three part streams, for example, the control roller 24.3 is removed from every third clamping element and cams 23.1 and 23.2 comprise a break at the beginning of the transformation zone before continuing further downstream.

Figure 12:
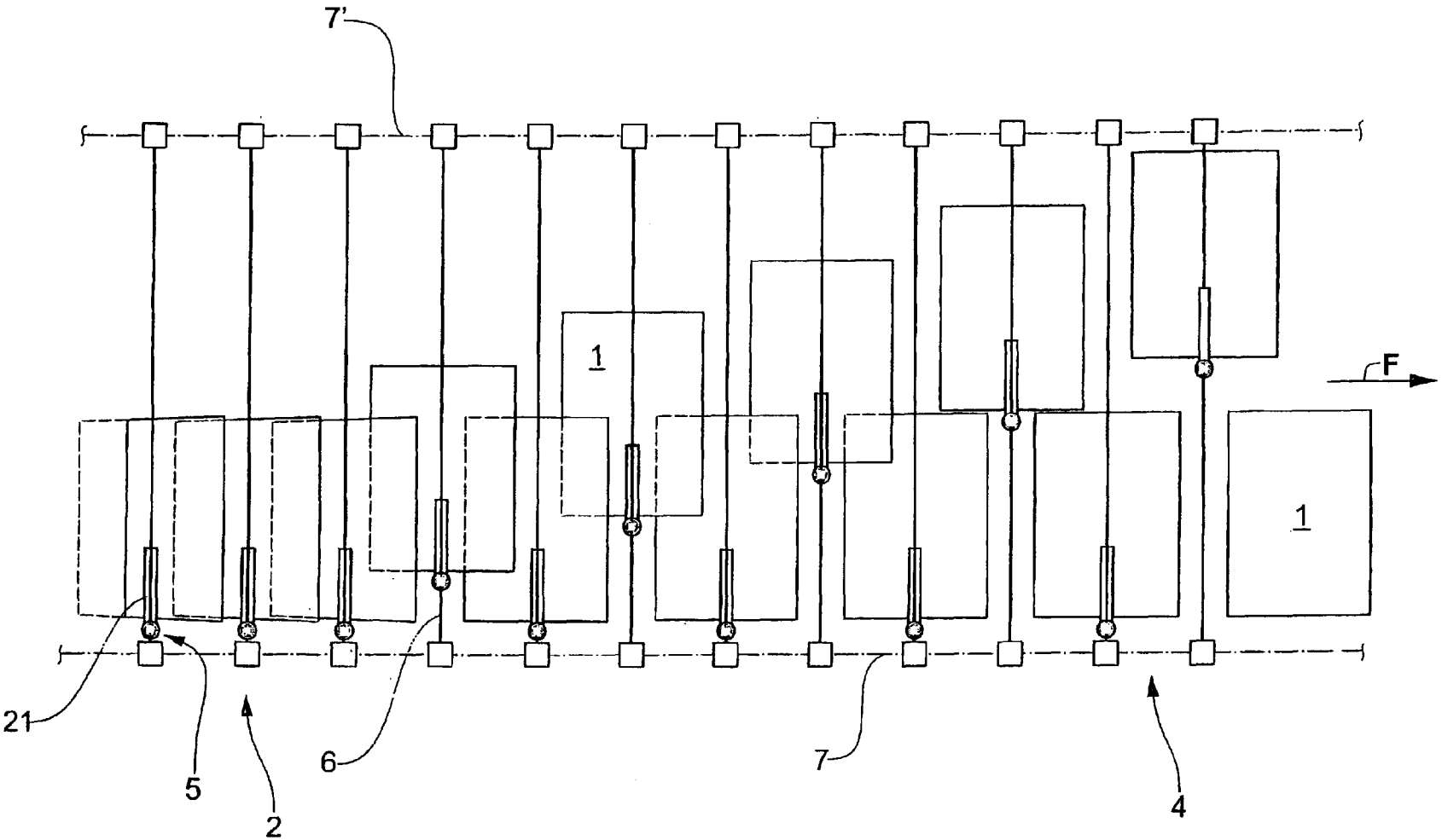
FIG. 12 is a schematic illustration of a further exemplary embodiment of the method and the device according to the invention, wherein the stream elements are gripped at an edge zone and are displaced parallel to their flat expanse (viewed in a direction vertical to the flat expanse of the stream elements)

FIG. 12 in the same manner as FIG. 1 illustrates an embodiment of the method and the device in accordance with the invention. In this embodiment clamping elements 5, as shown in FIG. 11, are equipped with clamps 21 instead of clamping heads. The clamping elements 5 are displaceable along guide links 6 whose ends are mounted on conveying organs 7 and 7'. The clamps 21 grip the stream elements 1 in the area of a lateral edge and are alternately displaced to a different extent in the same direction transverse to the conveying direction F. The transformation such achieved is about the same as the one illustrated in FIG. 1.

Figure 13:
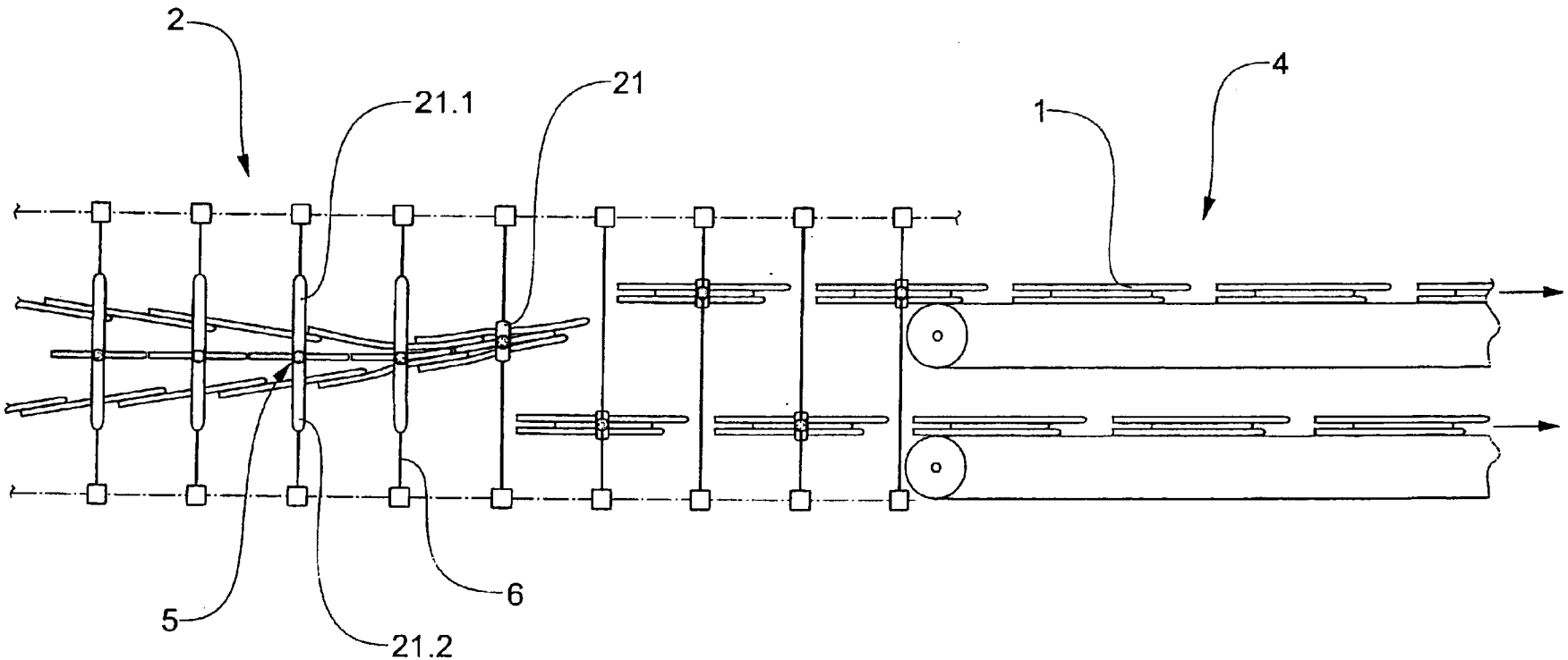
FIG. 13 is a schematic depiction of a further exemplary embodiment of the method and device in accordance with the invention, wherein the stream elements are gripped at an edge zone and are displacement transverse to the flat expanse of the stream elements (viewed in a direction parallel to the flat expanse of the stream elements).

FIG. 13 shows the transformation of a supply stream 2 viewed in a direction parallel to the flat expanse of the stream elements 1. In the supply stream 2, the same as in the supply stream of FIG. 3, objects of adjacent stream elements overlap one another. The clamping elements 5 are equipped with clamps 21 (clamp parts 21.1 and 21.2) and they are displaced along guide links 6. If the stream elements are supplied and conveyed away being loosely supported, i.e. being oriented essentially horizontally, the guide links 6 are vertically oriented and the clamping elements 5 with the clamps 21 are displaced upwards and downwards.

What is claimed is:

1. A method for transforming a supply stream (2) in which stream elements (1), each having two substantially parallel principal surfaces and each comprising one flat object or a group of flat objects lying on top of one another, are conveyed in a conveying direction (F), wherein the principal surfaces of the stream elements are oriented essentially parallel to the conveying direction (F), the method comprising the steps of:

during further conveyance in the conveying direction (F), gripping each stream element (1) of the supply stream (2) by clamping each stream element in a substantially identical location, which location, in the conveying direction (F), lies in a central area of the stream element and in which location the stream element is not overlapped by adjacent stream elements; and, during further conveyance in the conveying direction (F), displacing each stream element transverse to the conveying direction (F), displacement of successive stream elements (1) differing in a predefined sequence.

2. The method according to claim 1, wherein the stream elements (1) are conveyed loosely supported, in the supply stream (2) and/or after being released from being held gripped.

3. The method according to claim 1, wherein, during displacement transverse to the conveying direction (F), the stream elements (1) are additionally supported.

4. The method according to claim 1, wherein, in the supply stream (2), the stream elements (1) are conveyed overlapping one another and, following displacement, the stream elements do not overlap one another or an element overlap is different from the element overlap in the supply stream (2).

5. The method according to claim 1, wherein displacement transverse to the conveying direction (F) is carried out substantially parallel to the principal surfaces of the stream elements (1).

6. The method according to claim 5, wherein the predefined sequence of displacement transverse to the conveying direction (F) of subsequent ones of the stream elements (1) and the extent of the displacements is such that the supply stream (2) is transformed to a conveying stream (4) in which the stream elements (1) are distanced from one another in the conveying direction (F) and transverse to the conveying direction.

7. The method according to claim 6, wherein the conveying stream (4), in which the stream elements (1) are conveyed at a distance between one another in the conveying direction (F) and transverse to it, (1) is conveyed onward together with a quasi endless length of a packaging material (9).

8. The method according to claim 1, wherein the location in which the stream elements (1) are gripped is situated, relative to a direction transverse to the conveying direction (F), in a central area of the stream elements (1).

9. The method according to claim 1, wherein the locations in which the stream elements (1) are gripped comprises a lateral edge of the stream elements (1).

10. The method according to claim 1, wherein displacement transverse to the conveying direction (F) is carried out transverse to a flat expanse of the stream elements (1).

11. The method according to claim 1, wherein the stream elements (1) are groups of flat objects lying loosely on top of one another and having differing formats, or groups of flat objects having the same format and lying on top of one another non-regularly stacked, wherein the flat objects of each group are aligned to one another such that the group comprises a location situated relative to the conveying direction (F) in a central element area and, relative to a direction transverse to the conveying direction in a central element area too or in an area comprising one lateral element edge, in which location all flat objects of the group are grippable in a clamping manner.

12. The method according to claim 11, wherein at least a part of the flat objects are printed products.

13. A device for transforming a supply stream (2), in which stream elements (1) each having two substantially parallel principal surfaces and each comprising one flat object or a group of flat objects lying on top of one another, are conveyed in a conveying direction (F), wherein the principal surfaces of the stream elements (1) are oriented essentially parallel to the conveying direction (F), the device comprising:

a plurality of clamping elements (5, 5.1, 5.2) for gripping the stream elements of the supply stream (2) in a clamping manner, the clamping elements (5, 5.1, 5.2) being arranged on conveying means equipped for conveying the clamping elements in the conveying direction (F) one behind the other through-a transformation zone at a speed that is similar to a speed of the supply stream (2) and at a spacing that is similar to an element spacing in the supply stream (2), and control means acting on the clamping elements (5, 5.1, 5.2) during conveyance in the conveying direction, by activating the clamping elements, by displacing successive clamping elements transverse to the conveying direction (F) in a predefined sequence, and by de-activating the clamping elements.

14. The device according to claim 13, wherein the clamping elements (5, 5.1, 5.2) are adapted to be displaced along guide links (6, 6.1, 6.2) oriented transverse to the conveying direction (F).

15. The device according to claim 14, wherein the guide links (6, 6.1, 6.2) are driven by drive means (7, 7', 7.1, 7.1', 7.2, 7.2') extending on opposite sides of the supply stream (2) and running at least partially parallel to the supply stream.

16. The device according to claim 13, further comprising conveying substrates (3.1 to 3.6), said conveying substrates being adapted to loosely support the stream elements (1) for conveying the supply stream (2) to the transformation zone and for conveying the conveying stream (4) produced by the transformation away from the transformation zone.

17. The device according to claim 16, wherein the guide links (6, 6.1, 6.2) are oriented essentially horizontally.

18. The device according to claim 17, wherein, for gripping each stream element (1) in a clamping manner, a pair of clamping elements (5.1, 5.2) is provided, each clamping element being equipped with a clamping head (20), the clamping heads of the pair of clamping elements being oriented towards each other.

19. The device according to claim 17, wherein, for gripping the stream elements (1) in a clamping manner, upper clamping elements (5.1) and counter elements (11.1, 11.2) are provided, and wherein the counter elements (11.1, 11.2) are arranged on a plurality of conveying organs (10.1, 10.2) diverging within the transformation zone.

20. The device according to claim 17, wherein, for gripping the stream elements (1) in a clamping manner, clamping elements (5) with a clamp (21) each are provided, wherein the clamps (21) are equipped for activation by closing and for de-activation by opening.

* * * * *

UNITED STATES PATENT AND TRADEMARK OFFICE

CERTIFICATE OF CORRECTION

PATENT NO. : 6,786,328 B2
DATED : September 7, 2004
INVENTOR(S) : Werner Honegger It is certified that error appears in the above-identified patent and that said Letters Patent is hereby corrected as shown below:

Column 12,
Line 8, delete “locations” and insert therefore -- location --.
Line 41, delete “through-a” and insert therefore -- through a --.

Signed and Sealed this

Twenty-first Day of December, 2004

JON W. DUDAS
*Director of the United States Patent and Trademark Office*